US007274307B2

(12) United States Patent
Povey et al.

(10) Patent No.: US 7,274,307 B2
(45) Date of Patent: Sep. 25, 2007

(54) TRAFFIC LIGHT VIOLATION INDICATOR

(75) Inventors: Philip F. Povey, Mission Viejo, CA (US); Kevin Karamanos, Irvine, CA (US); Denny Jenner, Mission Viejo, CA (US)

(73) Assignee: PDK Technologies, LLC, Mission Viejo, CA (US)

( * ) Notice: Subject to any disclaimer, the term of this patent is extended or adjusted under 35 U.S.C. 154(b) by 236 days.

(21) Appl. No.: 11/183,521

(22) Filed: Jul. 18, 2005

(65) Prior Publication Data

US 2007/0013552 A1 Jan. 18, 2007

(51) Int. Cl.
*G08B 1/095* (2006.01)

(52) U.S. Cl. ..... 340/907; 340/931; 340/815.66; 362/269; 362/84

(58) Field of Classification Search ..... 340/907, 340/929, 930, 931, 932.1, 927, 815.4, 815.45, 340/815.66, 815.78; 362/269, 555, 84, 371, 362/800, 802
See application file for complete search history.

(56) References Cited

U.S. PATENT DOCUMENTS 3,920,967 A 11/1975 Martin et al.
4,023,017 A 5/1977 Ceseri
4,031,510 A 6/1977 King
4,591,823 A 5/1986 Horvat
4,847,772 A 7/1989 Michalopoulos et al.
5,041,828 A * 8/1991 Loeven ..... 340/937
5,161,107 A 11/1992 Mayeaux et al.
5,289,183 A 2/1994 Hassett et al.
5,381,155 A 1/1995 Gerber
5,530,441 A 6/1996 Takatou et al.
5,646,853 A 7/1997 Takahashi et al.
5,696,503 A 12/1997 Nasburg
5,761,326 A 6/1998 Brady et al.
5,767,794 A 6/1998 Borsch et al.
5,774,569 A 6/1998 Waldenmaier
5,801,943 A 9/1998 Nasburg
5,886,738 A 3/1999 Hollenbeck et al.
5,948,038 A 9/1999 Daly et al.
5,952,941 A 9/1999 Mardirossian
6,100,819 A * 8/2000 White ..... 340/933
6,144,317 A * 11/2000 Sims ..... 340/907

(Continued)

OTHER PUBLICATIONS

PDK Technologies, Inc.; "Safety Stop II".

*Primary Examiner*—Toan N. Pham
(74) *Attorney, Agent, or Firm*—Stetina Brunda Garred & Brucker

(57) ABSTRACT

Provided is a signal violation indicator for signaling the phasing of a vehicular control signal. The vehicular control signal may have a control circuit including at least a first traffic lamp and a second traffic lamp. The signal violation indicator comprises a light assembly and a base assembly. The light assembly included a first light source in data communication with the control circuit and a second light source concentrically mounted about the first light source and in data communication with the control circuit. The base assembly is connected to the light assembly and may be mounted adjacent to the vehicular control signal. The base assembly is configured to allow for selective directional control or aiming of the light assembly. The signal violation indicator is configured such that the first and second light sources are alternately activated in coordination with phasing of respective ones of the first and second traffic lamps.

20 Claims, 4 Drawing Sheets

U.S. PATENT DOCUMENTS 6,188,329 B1 2/2001 Glier
6,188,778 B1 2/2001 Higashikubo et al.
6,268,805 B1 * 7/2001 Simon ..... 340/907
6,384,740 B1 5/2002 Al-Ahmed
6,466,260 B1 * 10/2002 Hatae et al. ..... 348/149
6,556,916 B2 4/2003 Waite et al.
6,573,929 B1 * 6/2003 Glier et al. ..... 348/149
6,950,789 B2 * 9/2005 Laird et al. ..... 703/8

* cited by examiner

TRAFFIC LIGHT VIOLATION INDICATOR

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates to traffic surveillance systems and, more particularly, to a traffic signal violation indicating system specifically adapted for signaling the phasing of a traffic control signal and which signal violation indicating system is viewable from a strategic location.

Vehicular traffic at intersections is commonly controlled through the use of vehicular control signals which typically comprise traffic lamps having a green light, a yellow light and a red light. As is commonly known, the green traffic lamp signifies that traffic may proceed through an intersection. The red traffic lamp signifies that oncoming traffic must stop. The yellow traffic lamp symbolizes caution and warns oncoming traffic that the vehicular control signal is changing from green to red. Traffic through the intersection is regulated by the cycling of the vehicular control signal by sequentially activating the yellow, red and green traffic lamps.

Most vehicular control signals are positioned at traffic intersections so as to be visible to oncoming traffic. However, such vehicular control signals are also preferably positioned so that they are not visible to side traffic in order to prevent side traffic from anticipating changing of the vehicular control signal and unlawfully entering the intersection in anticipation of the signal changing from red to green. As a deterrent, most traffic lamps include blinders that further prevent viewing by side traffic. Occasionally, motorists unlawfully enter an intersection after the vehicular control signal has cycled from yellow to red in an attempt to avoid waiting for the next cycling of the vehicular control signal. Such practices by motorists are dangerous in that running through an intersection after the vehicular control signal has changed from yellow to red may lead to accidents that result in serious property damage, personal injury and occasionally death.

In an effort to minimize the risks posed by motorists who violate such vehicular control signals, law enforcement personnel occasionally monitor motorist compliance by positioning a patrol car or police motorcycle within view of the vehicular control signal as well as within view of the vehicular traffic to be controlled thereby. Ideally, law enforcement personnel are strategically located in a patrol car or on a police motorcycle that is hidden from view by motorists but which still allows law enforcement personnel to view the same traffic control signal that is being viewed by the motorist. Upon observing a motorist who violates a traffic control signal, law enforcement must then pursue the offending motorist through the intersection to stop the motorist and issue a citation.

Although violations of the vehicular control signal poses the above-mentioned risks to vehicular and pedestrian traffic, police pursuit of the offending motorist through the same intersection only exaggerates this risk. More specifically, police pursuit of the motorist through the intersection is even more dangerous because side traffic now has a green light and is proceeding through the intersection which presents an even further risk to the safety and welfare of law enforcement as well as to the safety of motorists. The dangers are further exaggerated due to the fact that the police officer must accelerate rapidly and travel at high speeds through the intersection in order to catch the motorist.

Included in the prior art are several attempts to mitigate the risks posed by the above-mentioned scenario. For example, the prior art includes camera surveillance systems that may be co-located with the vehicular control signals. Such camera surveillance systems are typically connected to the vehicular control signal and receive signals from sensors buried in pavement at the intersection. The camera surveillance system monitors the phasing of the vehicular control signal and the camera itself is triggered when a motorist passes over a stop line when the vehicular control signal has phased from yellow to red.

The camera surveillance system may then photograph the license plate of the offending vehicle as the motorist passes through the intersection. Data such as the date and time of day may be included with the photograph. The speed of the vehicle may also be included. Citations are then sent to the registered owner of the motor vehicle. Although effective in deterring the occurrence of violation of red traffic lights, such camera surveillance systems are typically expensive to manufacture and are complex to install and maintain.

As can be seen, there exists a need in the art for a traffic signal violation indicator that allows law enforcement to monitor motorist compliance of the vehicular control signal from a safe location. In addition, there exists a need in the art for a traffic signal violation indicator that further allows law enforcement to safely pursue offending motorists without having to first pass through the intersection after the phasing of the vehicular control signal. Also, there exists a need in the art for a signal violation indicator that is inexpensive to manufacture, install and maintain. Furthermore, there exists a need in the art for a signal violation indicator which is retrofittable to existing vehicular control signal systems. Finally, there exists a need in the art for a signal violation indicator that is readily connectable to an existing control circuit of the vehicular control signal.

BRIEF SUMMARY OF THE INVENTION

Provided is a signal violation indicator specifically adapted for signaling the phasing of a vehicular control signal such as may be installed at an intersection. The signal violation indicator is configured to be viewable from a variety of locations such as on a side of an intersection opposite that in which the vehicular control signal may be facing. In this manner, law enforcement may monitor motorist compliance with the phasing of the vehicular control signal without requiring such law enforcement to enter an intersection to pursue a motorist who has violated the vehicular control signal.

The vehicular control signal may include at least a first traffic lamp (i.e., a yellow traffic lamp) and a second traffic lamp (i.e., a red traffic lamp). The vehicular control signal may optionally include a control cabinet which may be mounted on a post adjacent the intersection. The vehicular control signal may be controlled via the control circuit which controls the phasing of the first traffic lamp (e.g., yellow) with the second traffic lamp (e.g., red) as well as other traffic lamps and devices (i.e., pedestrian "walk/don't walk" devices).

In its broadest sense, the signal violation indicator may comprise a light assembly mounted upon a base assembly. The signal violation indicator may be adapted to be interconnected and mounted upon the vehicular control signal and may be interconnected with the control circuit of the vehicular control signal such that the signal violation indicator may phase or cycle in coordination with phasing of the first and second traffic lamps.

The light housing which may be configured in a hollow or tubular shape and may have a cylindrical shape or a slight conical shape. Also included with the light assembly may be a first light source which is placed in data communication with the control circuit of the vehicular control signal. The first light source may have a circular shaped lens that is complimentary to the shape of the light housing. The light assembly may also include a second light source which is preferably configured to be mounted so as to circumscribe the first light The second light source may have a ring-shaped or annular shaped lens which circumscribes the first light source that is of circular shape. The first and second light sources may be coaxially mounted within the light housing and are configured to be alternately activated in coordination with phasing of the respective ones of the first and second traffic lights. More specifically, the first light source is illuminated in timing with illumination of the first traffic lamp which may be the yellow lamp. Likewise, the second light source may be illuminated in timing with the illumination of the second traffic lamp which may be a red lamp.

The signal violation indicator may be configured to be in data communication with the vehicular control signal via conductive wiring such as via the base assembly. The first and second light sources may be interconnected to respective ones of the first and second traffic lamps via the control circuit. Actuation of the first light source and the second light source in coordination with the first and second traffic lamps is provided by data communication between the first and second traffic lamps and the respective ones of the first and second light sources.

The base assembly is configured to allow for the selective directional control of the light assembly such that an observer may view the phasing of the vehicle control signal at a remote location from which the vehicular control signal is not observable. More specifically, the base assembly is configured to allow viewing of the light assembly by an observer such that viewing of the vehicular control signal is not required in order to detect actual phase changes of the vehicular control signal. For example, the light assembly may be oriented to face in a direction that is generally opposite the orientation of the vehicular control signal. The light assembly may be positioned such that a police officer may be located on a corner of an intersection in order to catch motorists violating the vehicular control signal whenever such motorist passes through the intersection in violation of the red traffic lamp.

BRIEF DESCRIPTION OF THE DRAWINGS

These as well as other features of the present invention will become more apparent upon reference to the drawings wherein.

DETAILED DESCRIPTION OF THE INVENTION

Figure 1:
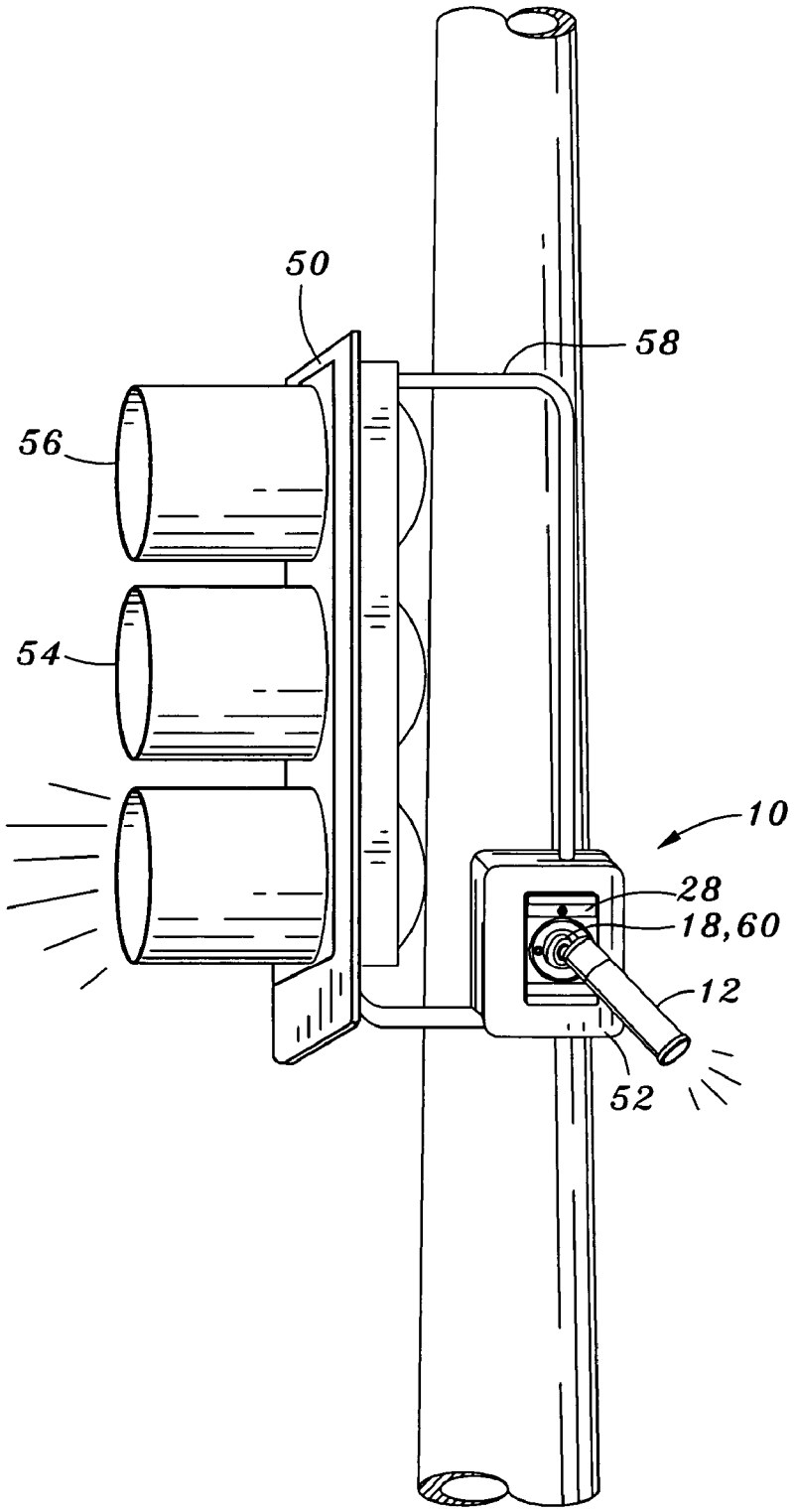
FIG. 1 is a perspective view of a signal violation indicator of the present invention as may be mounted adjacent a vehicular control signal at a traffic intersection.

Referring now to the drawings wherein the showings are for purposes of illustrating the present invention and not for purposes of limiting the same, shown in FIGS. 1-7 is a signal violation indicator 10 specifically adapted for signaling the phasing of a vehicular control signal 50 such as may be installed at an intersection. Advantageously, the signal violation indicator 10 is configured to be viewable from a variety of locations such as from a side or corner of an intersection opposite the side from which the vehicular control signal 50 is facing. In this manner, law enforcement personnel may monitor motorist compliance with the vehicular control signal 50 without requiring such personnel to enter an intersection to pursue an offending motorist.

Vehicular control signals 50 of the type that are employed to regulate traffic include at least a first traffic lamp 54 (e.g., a yellow traffic lamp) and a second traffic lamp 56 (e.g., a red traffic lamp). As is commonly known, such vehicular control signal 50 typically comprises three (3) traffic lamps which include the red, yellow and green traffic lamps. However, additional traffic lamps such as left-turn traffic lamps may be also included with the vehicular control signal 50. The vehicular control signal 50 may optionally include a control cabinet 52. The control cabinet 52 may be mounted on a post which may be positioned on a median or a sidewalk adjacent the intersection. The vehicular control signal 50 may be controlled or regulated via the control circuit 58 which controls the phasing of the first traffic lamp 54 with the second traffic lamp 56 as well as other traffic lamps and traffic devices (i.e., pedestrian "walk/don't walk" devices).

Referring now to FIGS. 1-7, shown is the signal violation indicator 10 of the present invention which, in its broadest sense, comprises a light assembly 12 mounted upon a base assembly 18. The signal violation indicator 10 may be adapted to be interconnected and mounted upon a pole or upon the vehicular control signal 50 itself such as via mounting screws 46. In this manner, the signal violation indicator 10 may be interconnected with the control circuit 58 of the vehicular control signal 50 such that the signal violation indicator 10 may phase in coordination with phasing of respective ones of the first and second traffic lamps 54, 56.

Figure 2:
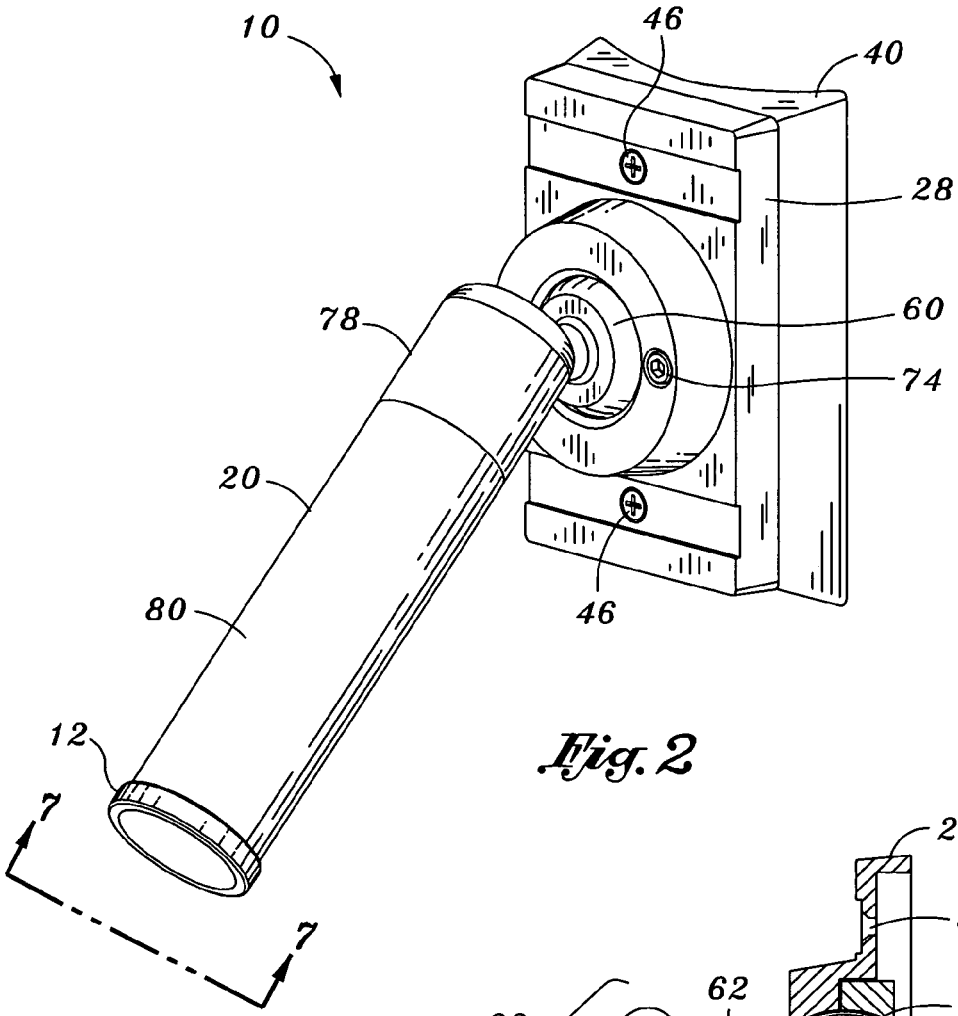
FIG. 2 is a perspective view of the signal violation indicator in one embodiment and illustrating a light assembly and a base assembly that comprise the signal violation indicator.
Figure 3:
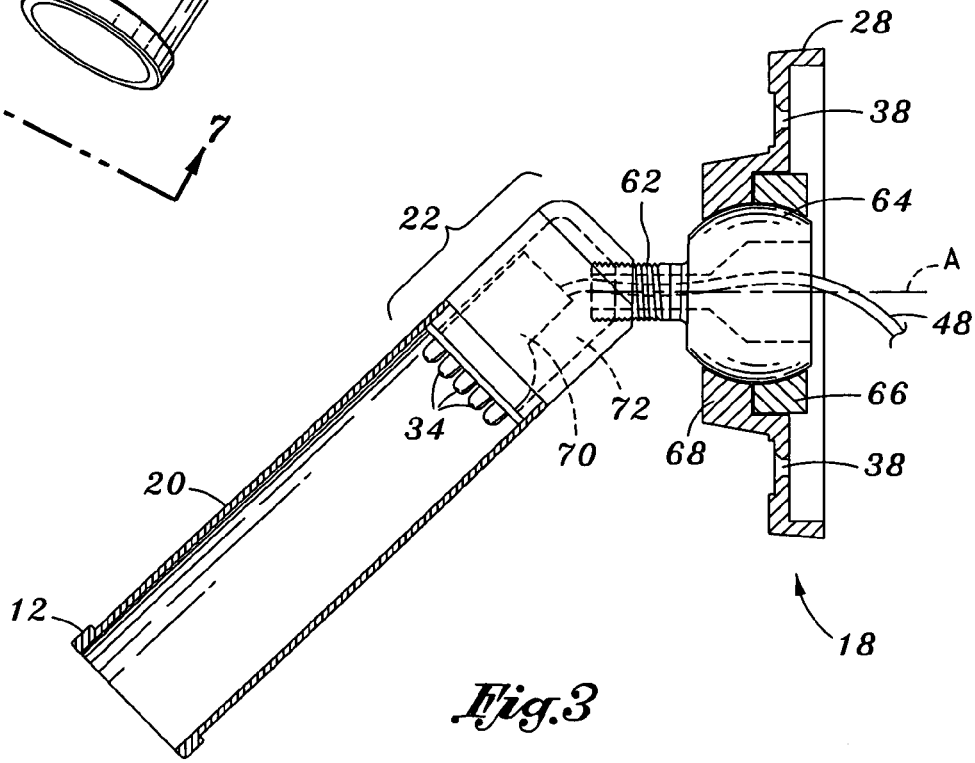
FIG. 3 is a cross-sectional view of the signal violation indicator of FIG. 2 and illustrating a ball joint of the base assembly and an electronic module of the light assembly.
Figure 5:
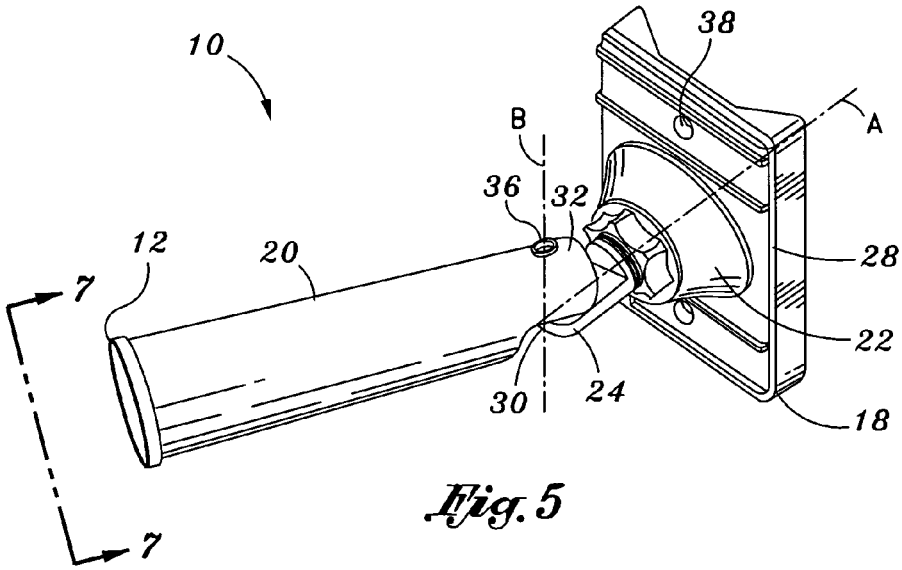
FIG. 5 is a front perspective view of the signal violation indicator illustrating an alternative configuration of the base assembly.
Figure 6:
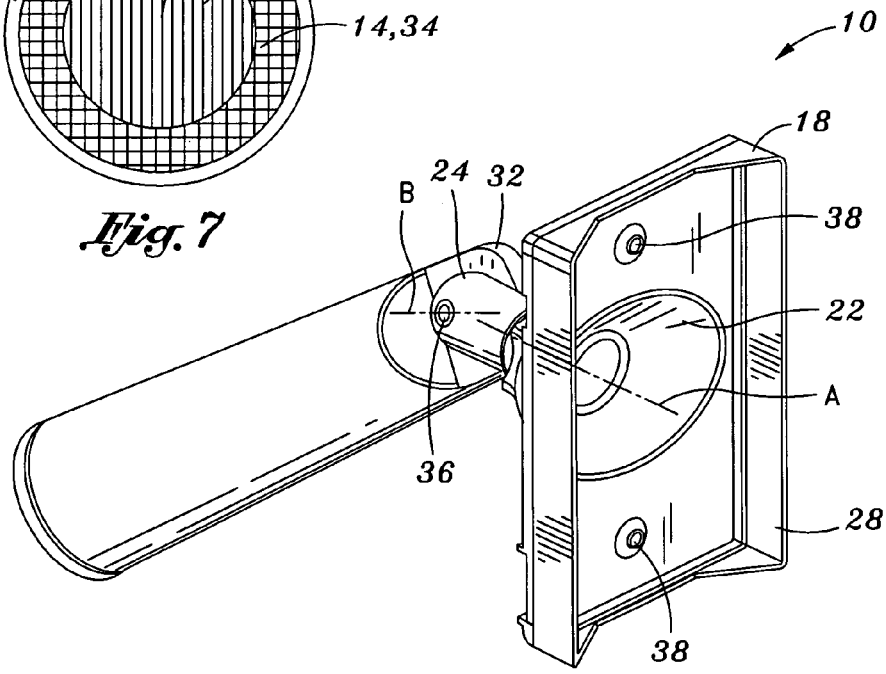
FIG. 6 is a rear perspective view of the signal violation indicator shown in FIG. 5.

As can be seen in FIG. 2-3 the light assembly 12 may include a light housing 20 which may be configured in a hollow or tubular shape. Furthermore, the light housing 20 may have a cylindrical shape (as shown in FIGS. 1-4*b*) or a conical shape (as shown in FIGS. 5-6). However, it is contemplated that the light housing 20 may be configured in any shape. Also included with the light assembly 12 may be a first light source 14 which is placed in data communication with the control circuit 58 of the vehicular control signal 50. The first light source 14 may have a circular shaped lens 26 that is complimentary to the shape of the light housing 20. The light assembly 12 may also include a second light source 16 which is preferably configured to be mounted so as to circumscribe the first light source 14.

Figure 7:
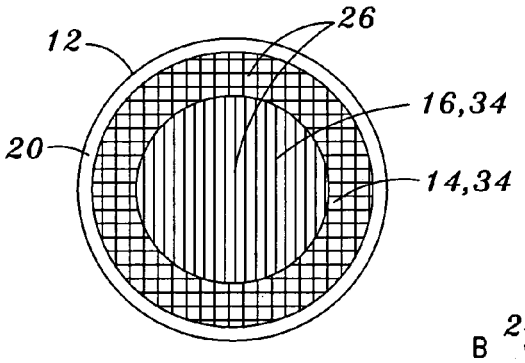
FIG. 7 is a front view of first and second light sources of the light assembly taken along lines 7-7 of FIGS. 2 and 5.

As can been seen in FIG. 7, the second light source 16 may have an ring-shaped or annular-shaped lens 26 which circumscribes the first light source 14 that is of circular shape. The first and second light sources 14, 16 may be coaxially mounted within the light housing 20 and are configured to be alternately activated in coordination with phasing of the respective ones of the first and second traffic lamps 54, 56. More specifically, the first light source 14 is configured to be activated in coordination with the first traffic lamp 54 of the vehicular control signal 50. Likewise, the second light source 16 is configured to be activated in coordination with the second traffic lamp 56 of the vehicular control signal 50. In this regard, the first light source 14 is illuminated in timing with illumination of the first traffic lamp 54 which may be the yellow lamp. Likewise, the second light source 16 may be illuminated in timing with the illumination of the second traffic lamp 56 which may be a red lamp.

It should be noted that although the signal violation indicator 10 is shown as having only a first light source 14 and a second light source 16, any number of light sources may be included with the light assembly 12. For example, the light assembly 12 may include the first light source 14, the second light source 16 and a third light source which may be annularly shaped and which may circumscribe the second light source 16. Like the first and second light sources 14, 16, the third light source may be configured to be activated in coordination with the illumination of a third traffic lamp which may be a green traffic lamp. Furthermore, additional light sources may be provided with the light assembly 12 to correspond and be activated in coordination with respective ones of fourth and fifth and additional traffic lamps of the vehicular control signal 50.

It is contemplated that the first and second light sources 14, 16 of the light assembly 12 may be comprised of light-emitting-diodes (LED's) 34, as will be described in greater detail below. However, alternative sources may be used for illuminating the first and second light sources 14, 16. For example, incandescent bulbs may be used to illuminate the first and second light sources 14, 16. The first and second traffic lamps 54, 56 may have yellow and red lenses 26, respectively. Likewise, the first and second light sources 14, 16 may be provided with yellow and red lenses 26, respectively.

Also included with the signal violation indicator 10 is the base assembly 18 which is connected to the light assembly 12. As can be seen in FIGS. 1-6, the base assembly 18 is preferably, but optionally, mounted adjacent to the vehicular control signal 50 which is typically positioned adjacent the intersection. More specifically, the vehicular control signal 50 is typically supported by a cable or a traffic light pole or other support means. As is shown in FIG. 1, the vehicular control signal 50 may be mounted on a pole such as a traffic light pole and may include conduit which houses the control circuit 58 of the vehicular control signal 50.

The signal violation indicator 10 may be configured to be in data communication with the vehicular control signal 50 via conductive wiring 48 such as via the base assembly 18. However, it is contemplated that the signal violation indicator 10 may be in wireless communication with the vehicular control signal 50. The first and second light sources 14, 16 may be interconnected to respective ones of the first and second traffic lamps 54, 56 via the control circuit 58. As will be described in greater detail below, actuation of the first light source 14 and the second light source 16 in coordination with the first and second traffic lamps 54, 56 is provided by data communication between the first and second traffic lamps 54, 56 and the respective ones of the first and second light sources 14, 16.

Importantly, the base assembly 18 is configured to allow for the selective directional control of the light assembly 12 such that an observer (e.g., law enforcement) may view the phasing of the vehicle control signal from a remote location. More specifically, the base assembly 18 is configured to allow viewing of the light assembly 12 by an observer such that viewing of the vehicular control signal 50 is not required for detecting actual phase changes of the vehicular control signal 50. For example, as shown in FIG. 1, the light assembly 12 is illustrated as being oriented to face in a direction that is generally opposite the orientation of the vehicular control signal.

The light assembly 12 may be positioned such that a police officer may be located on a corner of an intersection in order to catch motorists violating the vehicular control signal 50 whenever such motorist passes through the intersection in violation of the second traffic lamp 56 (i.e., the red traffic lamp). In this manner, upon viewing the violation of the second traffic lamp 56, the police officer may pursue the offending motorist without having to pass through the intersection.

The base assembly 18 may further include an electronic module 22 which may conductively connect the first light source 14 to the control circuit 58. Furthermore, the electronic module 22 may conductively connect the second light source 16 to the control circuit 58. The base assembly 18 may also include a base housing 28, as shown in FIGS. 1-6, and which is configured to be mounted on a control cabinet 52 of the vehicular control signal 50. The base housing 28 may also be mounted on a pole such as a traffic signal pole or the like. The base housing 28 may include apertures 38 through which mounting screws 46 are extended for engagement to the control cabinet 52 or pole. The control cabinet 52 may be configured to provide access to the control circuit 58 of the vehicular control signal 50 such that maintenance or manual operation of the vehicle control signal 50 is facilitated thereby.

Referring to FIGS. **2-4*b*, the base assembly 18 may be configured as a ball joint 60 for directional aiming of the light assembly 12 over a large field of view. In general, the ball joint 60 comprises an inner socket portion 66, an outer socket portion 68 and a ball portion 64 aligned along a base axis A, indicated by the reference character "A". The ball portion 64 may be hollow to allow for wiring 48 to pass therethrough. The inner socket portion 66 is preferably a separate component from the base housing 28. The inner socket portion 66 may be generally shaped as an annular ring and have a partially spherical inner surface. The outer socket portion 68 also has a spherical inner surface. The outer socket may be integrally formed with the base housing 28 or it may be a separate component. The outer socket portion 68 is preferably mateable to the inner socket portion 66 as shown in FIGS. 3-4*b* in a manner such that the inner and outer socket portions 66, 68** collectively form a socket.

In this regard, a pair of mechanical fasteners may be used to engage the inner and outer socket portions 66, 68 together to collectively form the socket. Toward this end, the mechanical fasteners are configured as a pair of ball joint tensioners 74 that are extended through tensioner holes 76 in the outer socket portion 68 and threadably engaged to the inner socket portion 66. Tightening or loosening of the ball joint tensioners 74 effectuates relative axial motion between the inner and outer socket portions 66, 68, and controls the amount of clamping force against the ball joint 60. In this manner, the ball joint tensioners 74 facilitate aiming of the light assembly 12 wherein the ball joint tensioners 74 may first be loosened while the light housing 20 is aimed and the ball joint tensioners 74 are then re-tightened.

Figure 4A:
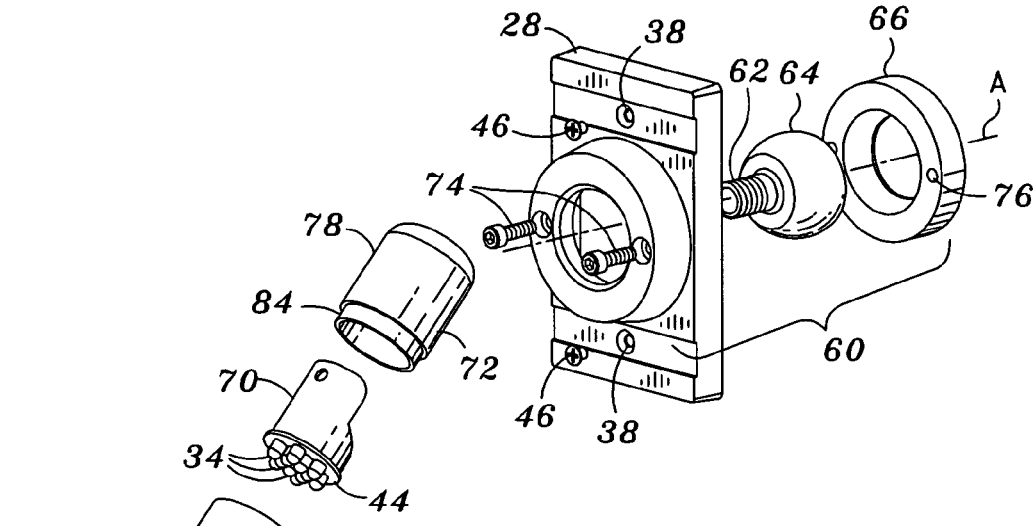
FIG. 4*a* is a front exploded view of the signal violation indicator.
Figure 4B:
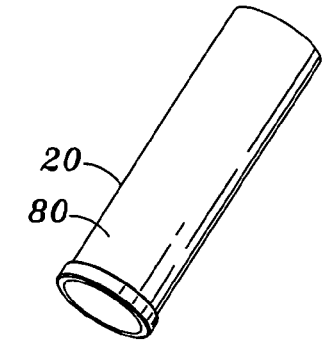
FIG. 4*b* is a rear exploded view of the signal violation indicator.
Figure 4B:
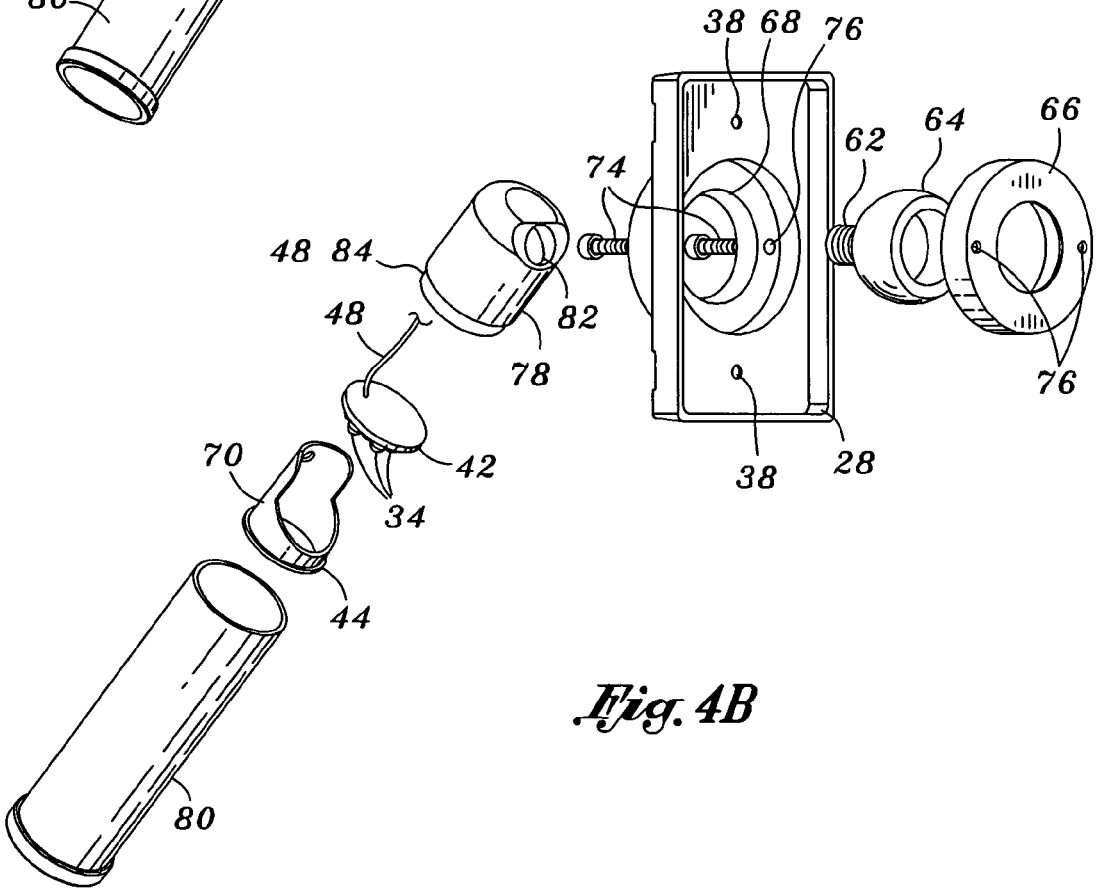

As shown in FIGS. 3-4*b*, the ball portion 64 is generally spherically shaped complementary to the socket and is configured to be slidably contained within the socket. The ball portion 64 is preferably rigidly affixed to the light housing 20 through an extension portion 62 that extends laterally outwardly. To facilitate attachment of the ball portion 64 to the light housing 20, the extension portion 62 may be cylindrically shaped to enable insertion thereof into a mounting feature in the light housing 20. The extension portion 62 may include threads to facilitate attachment to the light housing 20 with a threaded nut.

To further facilitate attachment of the extension portion 62 to the light housing 20, a mounting flange 82 may be provided on the light housing 20 as shown in FIG. 4*b*. The light housing 20 may be comprised of an inner housing portion 78 and an outer housing portion 80 with the inner housing portion 78 having the mounting flange 82 extending laterally outwardly therefrom. The extension portion 62 may be engageable within the mounting flange 82 to rigidly secure the light housing 20 to the ball joint 60 to prevent relative movement therebetween. The mounting flange 82 may be offset from an axial centerline of the inner housing portion 78 to facilitate the desired orientation of the light housing 20 in a generally downwardly facing direction to allow viewing thereof by law enforcement personnel at the vehicular control signal 50.

Referring to FIGS. 5-6, in an alternative arrangement, the base assembly 18 may include a base swivel arm 30 which may extend outwardly from the base housing 28. The base swivel arm 30 defines the base axis A about which the base swivel arm 30 is configured to be selectively rotatable. The base assembly 18 may also include a housing swivel arm 32 which extends outwardly from the light housing 20 and which is connected to the base swivel arm 30. The housing swivel arm 32 may be selectively rotatable relative to the base swivel arm 30. In this regard, the housing swivel arm 32 is rotatable about a housing axis indicated in FIG. 5 by the character "B". The base axis A is preferably oriented orthogonally relative to the housing axis B although a variety of alternative orientations are contemplated.

An elongate pin 36 may interconnect the base swivel arm 30 to the housing swivel arm 32 such that the light housing 20 is rotatable about the pin 36. As can be seen in FIG. 5, the light assembly 12 is preferably configured to be pivotable about the housing axis B while the base swivel arm 30 is preferably configured to be rotatable about the base axis A. The unique configuration of the base axis A with the housing axis B enables the light assembly 12 to be rotated over a wide field of view such that the light assembly 12 is easily viewable from a number of different locations by law enforcement. As can be seen in FIG. 2, the base assembly 18 is preferably configured as the ball joint 60 but may alternatively be configured as an articulated swivel 24 as shown in FIG. 5. Regardless of the chosen arrangement, the base assembly 18 is configured to allow for directional aiming of the light assembly 12 over a field of view to allow for observation of the phasing of the first and second light sources 14, 16 from a wide variety of positions adjacent to the intersection.

The electronic module 22 is preferably configured to be connectable to wiring 48 which is pre-installed and which may be incorporated into the control circuit 58 of the vehicular control signal 50. In this regard, the electronic module 22 is preferably connectable to the control circuit 58 such that the first light source 14 is in data communication with the first traffic lamp 54 and the second light source 16 is in data communication with the second traffic lamp 56. The first and second light sources 14, 16 may be alternately activated in coordination with phasing of respective ones of the first and second traffic lamps 54, 56.

Referring to FIGS. 3-4*b*, the electronic module 22 may include a pod member 70 in and a circuit board 42. The pod member 70 may be mounted within the light assembly 12 wherein the pod member 70 may have a generally cylindrical outer surface that is complementary to an inner surface of the inner housing portion 78. In turn, the pod member 70 may be mounted or abutted against a pod mounting member that positions the pod member 70 within the inner housing portion 78. In this regard, the pod mounting portion 72 is configured to axially and angularly position the pod member 70 within the light housing 20. The pod member 70 and pod mounting portion 72 are each preferably generally hollow elements that may be molded of plastic such as by injection molding although any suitable material can be used.

The circuit board 42 is preferably mounted within the pod member 70 as shown in FIG. 3-4*b* and has a plurality of light-emitting-diodes 34 mounted thereon for illuminating the first and second light sources 14, 16. Holes are provided in the pod member 70 through which the LED's 34 may protrude. Wiring 48 extending from an underside of the circuit board 42 electrically connects the electronic module 22 to the control circuit 58. A ridge 44 may be provided on the pod member 70 at a forward end thereof to seat the pod member 70 against an outer rim of the inner housing portion 78. An annular shoulder 84 may be formed due to the configuration of the inner housing portion 78 and the pod member 70. The outer housing portion 80 may be inserted in sleeve-like fashion over the annular shoulder 84 to align and affix the outer housing portion 80 to the inner housing portion 78.

The base housing 28 may be connected to the control cabinet 52 using mechanical fasteners such as mounting screws 46 which may be extended through apertures 38 provided in the base housing 28. In this regard, screws may be extended through the apertures 38 and threadably connected to the control cabinet 52 for rigidly securing the base assembly 18 to the vehicular control signal 50. A variety of alternative means may be provided for securing the base housing 28 to the control cabinet 52.

For example, the base housing 28 may be configured with mechanical features, such as tabs, which engage receiving features, such as notches, integrated into the control cabinet 52. Optionally, a secondary mounting member 40 may be secured to the base housing 28 to facilitate mounting the signal violation indicator 10 to a pole of a control signal (i.e., traffic light). As shown in FIG. 2, a curved mounting surface may be provided on the secondary mounting member 40 which preferably matches or approximate the curvature of the pole.

Regarding materials from which the signal violation indicator 10 may be fabricated, it is contemplated that the light housing 20 may be fabricated from any suitable material such as metallic or polymeric material. For example, the light housing 20 may be fabricated from aluminum, steel, or stainless steel. Alternatively, the light housing 20 may be fabricated from polycarbonate material although any suitable polymeric or metallic material may be used to fabricate the light housing 20.

As was previously mentioned, the first and second light sources 14, 16 may be comprised of light-emitting-diodes 34 which may be high-intensity light-emitting-diodes 34 to increase visibility and to reduce power consumption. The light-emitting-diodes 34 themselves may be provided in red and yellow colors. The light assembly 12 itself may preferably be fabricated so as to minimize degradation thereof due to exposure to weather elements. The first light source 14 may include a plastic housing to house the light-emitting-diodes 34. Likewise, the second light source 16 may include a plastic housing to contain the light-emitting-diodes 34.

The base housing 28 may be constructed of any suitable material such as metallic or polymeric material that is capable of withstanding continuous exposure to the environment. The base swivel arm 30 and the housing swivel arm 32 are preferably fabricated of a durable material to enable repositioning of the light assembly 12 with respect to the base assembly 18. As was previously mentioned, the base assembly 18 may be mounted upon any suitable structure adjacent to the vehicular control signal 50. For example, the base assembly 18 may be configured to be mounted on a traffic light pole which also may support the vehicular control signal 50. However, the base assembly 18 may be configured to be mounted on the control cabinet 52 of the vehicular control signal 50 in the manner described above.

The operation of the signal violation indicator 10 will now be described with reference to FIGS. 1-7. The signal violation indicator 10 is assembled such that the light assembly 12 is connected to the base assembly 18 using a variety of means as described above. For example, as referring to FIGS. 2-4*b*, the ball portion 64 of the ball joint 60 is initially loosened to allow sliding movement of the ball joint 60 within the socket. The ball joint tensioners 74, such as Allen-head screws, are preferably loosed to slightly unclamp the inner and outer socket portions 66, 68. Once the light assembly 12 is aimed, the ball joint tensioners 74 are tightened to securely clamp the ball portion 64 within the socket. Alternatively, in another configuration of the base assembly 18 as shown in FIGS. 2-3, the pin 36 may be inserted through the housing swivel arm 32 and the base swivel arm 30 for connection therebetween and the base assembly 18 may be swiveled to provide directional aiming of the light assembly 12 over a field of view.

The light assembly 12 is preferably aimed at a location whereat law enforcement are stationed to monitor motorist compliance with phasing of the traffic lamps 54, 56 of the vehicular control signal 50. For example, the light assembly 12 may be selectively aimed to allow viewing from a corner of an intersection opposite that from which motorists make left-hand turns. In this manner, offending motorists will pass by the law enforcement personnel after exit the intersection. Upon observing a violation, offending motorists may be easily pursued by law enforcement personnel without having to pass through the intersection through which traffic is moving in the opposite direction because of the recent phase change of the control signal.

As was earlier mentioned, the base assembly 18 may comprise the electronic module 22 which is configured to be mounted on the control cabinet 52 of the vehicular control signal 50 and which conductively connects the first and second light sources 14, 16 to respective ones of the first and second traffic lamps 54, 56. The electronic module 22 may be incorporated into the base assembly 18 and may comprise the base housing 28 as shown in FIG. 2. Selective directional aiming of the light assembly 12 may be facilitated by pivoting about the housing axis B and the base axis A with locking of the light assembly 12 into position through tightening of a threaded nut on the base assembly 18. Likewise, the pin 36 extending between the housing swivel arm 32 and the base swivel arm 30 may comprise a threaded fastener wherein a nut of the threaded fastener may be tightened once the light assembly 12 is moved to the desired position in order to fixedly engage the housing swivel arm 32 to the base swivel arm 30.

The signal violation indicator 10 is configured such that the first and second light sources 14, 16 are alternately activated in coordination with phasing of respective ones of the first and second traffic lamps 54, 56. More specifically, if the first light source 14 may be provided with a yellow lens 26, and the second light source 16 is provided with a red lens 26, phasing between the first traffic lamp 54, also having a yellow lamp, may be coordinated with phasing of the first light source 14. Likewise, phasing of the second traffic lamp 56 may be coordinated with phasing of the second light source 16.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A signal violation indicator for signaling the phasing of a vehicular control signal having a control circuit including at least a first traffic lamp and a second traffic lamp, the signal violation indicator comprising:

a light assembly, including:

a first light source in data communication with the control circuit; and a second light source concentrically mounted about the first light source and being in data communication with the control circuit; and a base assembly connected to the light assembly and being mounted adjacent to the vehicular control signal, the base assembly being configured to allow for selective directional control of the light assembly;

wherein the signal violation indicator is configured such that the first and second light sources are alternately activated in coordination with phasing of respective ones of the first and second traffic lamps.

2. The signal violation indicator of claim 1 wherein the first light source has a circular shaped lens and the second light source has an annular shaped lens circumscribing the first light source.

3. The signal violation indicator of claim 1 wherein the light assembly includes a tubular light housing with the first and second light sources being mounted therewithin.

4. The signal violation indicator of claim 1 wherein the vehicular control signal includes a control cabinet, the base assembly further comprising:

an electronic module configured to be mounted adjacent to the control cabinet and conductively connecting the first and second light sources to the control circuit.

5. The signal violation indicator of claim 4 wherein the electronic module comprises:

a pod member mounted within the light assembly; and a circuit board affixed to the pod member and having light-emitting-diodes mounted thereon for illuminating the first and second light sources.

6. The signal violation indicator of claim 4 wherein the electronic module is pre-wired to be connectable to the control circuit.

7. The signal violation indicator of claim 1 wherein the base assembly is configured as a ball joint for directional aiming of the light assembly over a field of view.

8. The signal violation indicator of claim 7 wherein the ball joint comprises:

an inner socket portion affixed to the base housing;

an outer socket portion mateable to the inner socket portion such that the inner and outer socket portions collectively form a socket; and a ball portion configured to be complementary to the socket and slidably contained therewithin the socket, the ball portion being rigidly affixed to the light housing.

9. The signal violation indicator of claim 1 wherein the base assembly is configured as an articulated swivel for directional aiming of the light assembly over a field of view.

10. The signal violation indicator of claim 9 wherein the articulated swivel comprises:

a base housing;

a base swivel arm extending from the base housing and defining a base axis about which the base swivel arm is selectively rotatable;

a housing swivel arm extending from the light housing and connected to the base swivel arm and being selectively rotatable about a housing axis;

wherein the housing axis is oriented orthogonally relative to the base axis.

11. The signal violation indicator of claim 1 wherein at least one of the first and second light sources is illuminated with light-emitting-diodes.

12. The signal violation indicator of claim 1 wherein the first and second traffic lamps have red and yellow lenses, respectively.

13. The signal violation indicator of claim 1 wherein the light housing is cylindrically shaped.

14. The signal violation indicator of claim 1 wherein the light housing is conically shaped.

15. A signal violation indicator for signaling the phasing of a vehicular control signal having a control circuit including at least a first and a second traffic lamp and a control cabinet, the signal violation indicator comprising:

a light assembly, including:

an elongate tubular light housing having a cylindrical shape;

a first light source in data communication with the control circuit, the first light source having a circular shaped lens; and a second light source having an annular shaped lens circumscribing the first light source, the first and second light sources being coaxially mounted within the light housing and being configured to be alternately activated in coordination with phasing of respective ones of the first and second traffic lamps;

an electronic module conductively connecting the first and second light sources to the control circuit, the electronic module comprising;

a pod member mounted within the light assembly; and a circuit board mounted within the pod member and having light-emitting-diodes mounted thereon for illuminating the first and second light sources; and a base assembly connected to the light assembly and being mounted adjacent to the vehicular control signal, the base assembly including:

a base housing configured to be mounted on the control cabinet; and a ball joint configured to allow for directional aiming of the light assembly, the ball joint comprising:

an inner socket portion affixed to the base housing;

an outer socket portion mateable to the inner socket portion such that the inner and outer socket portions collectively form a socket;

a ball portion slidably captured within the socket and being rigidly affixed to the light housing; and a pair of ball joint tensioners extending through the inner and outer socket portions and being configured to clamp the ball portion within the socket.

16. The signal violation indicator of claim 15 wherein:

the light housing is comprised of inner and outer housing portions;

the inner housing portion being mounted to the ball portion and having the electronic module mounted therewithin;

the outer housing portion being disposed in abutting contact with the inner housing portion and having the lenses of the first and second light sources disposed at a free end of the outer housing portion.

17. The signal violation indicator of claim 15 further including a secondary mounting member affixed to the base assembly and having a curved mounted surface.

18. The signal violation indicator of claim 15 wherein the electronic module is pre-wired to be connectable to the control circuit.

19. The signal violation indicator of claim 15 wherein the first and second traffic lamps have red and yellow lenses, respectively.

20. The signal violation indicator of claim 15 wherein the pod member is formed of plastic.

* * * * *